United States Patent [19]

Creed

[11] 4,141,753

[45] Feb. 27, 1979

[54] METHOD AND APPARATUS FOR CLEANING SUCTION DUCTS

[76] Inventor: Bruce W. Creed, 4379 S. Dye, Swartz Creek, Mich. 48473

[21] Appl. No.: 754,104

[22] Filed: Dec. 27, 1976

[51] Int. Cl.[2] ..... B08B 3/02; B08B 9/06

[52] U.S. Cl. ..... 134/8; 134/21; 134/22 C; 134/24; 134/167 C; 15/104.06 R

[58] Field of Search ..... 134/8, 21, 22 C, 24, 134/166 C, 167 C; 15/3.52, 104.06 A, 104.165, 104.18, 104.06 R

[56] References Cited

U.S. PATENT DOCUMENTS

| | | | |
|---|---|---|---|
| 526,141 | 9/1894 | Bloomer | 15/3.52 X |
| 1,274,931 | 8/1918 | Otterson | 134/21 X |
| 1,999,559 | 4/1935 | Brendlin | 15/3.52 X |
| 2,508,659 | 5/1950 | Brown | 15/104.06 R |
| 2,640,213 | 6/1953 | Robinson | 15/104.06 R |
| 2,669,217 | 2/1954 | Pearson | 15/104.06 R |
| 3,107,379 | 10/1963 | Hill | 15/104.06 R |
| 3,585,076 | 6/1971 | Prange | 134/24 X |
| 3,600,225 | 8/1971 | Parmalee | 134/24 X |
| 3,658,589 | 4/1972 | Shaddock | 134/24 X |
| 3,763,896 | 10/1973 | Horne et al. | 15/104.06 R |
| 3,874,926 | 4/1975 | Horne et al. | 134/24 |
| 3,885,286 | 5/1975 | Hill | 15/104.06 R |

FOREIGN PATENT DOCUMENTS

| | | | |
|---|---|---|---|
| 1014009 | 12/1965 | United Kingdom | 15/3.52 |

*Primary Examiner*—Richard V. Fisher

[57] ABSTRACT

Method and apparatus for the in situ, internal cleaning of a hollow, variable diameter, air and dirt evacuation duct which is coupled to a vacuum creating system. The apparatus comprises a fluid emitting member receivable in the duct for dislodging dirt and scale which might accumulate on the inside wall of the duct. Mechanism is provided for drawing the fluid emitting member through the duct including a line, coupled to the fluid emitting member, passing from the inlet to the outlet of the duct. An expansible and contractible member is received by the duct and is responsive to a differential pressure being created by the vacuum creating system to expand outwardly into intimate engagement with the internal wall of the duct and to move in a downstream direction whereby the line and fluid emitting member are moved through the duct.

10 Claims, 2 Drawing Figures

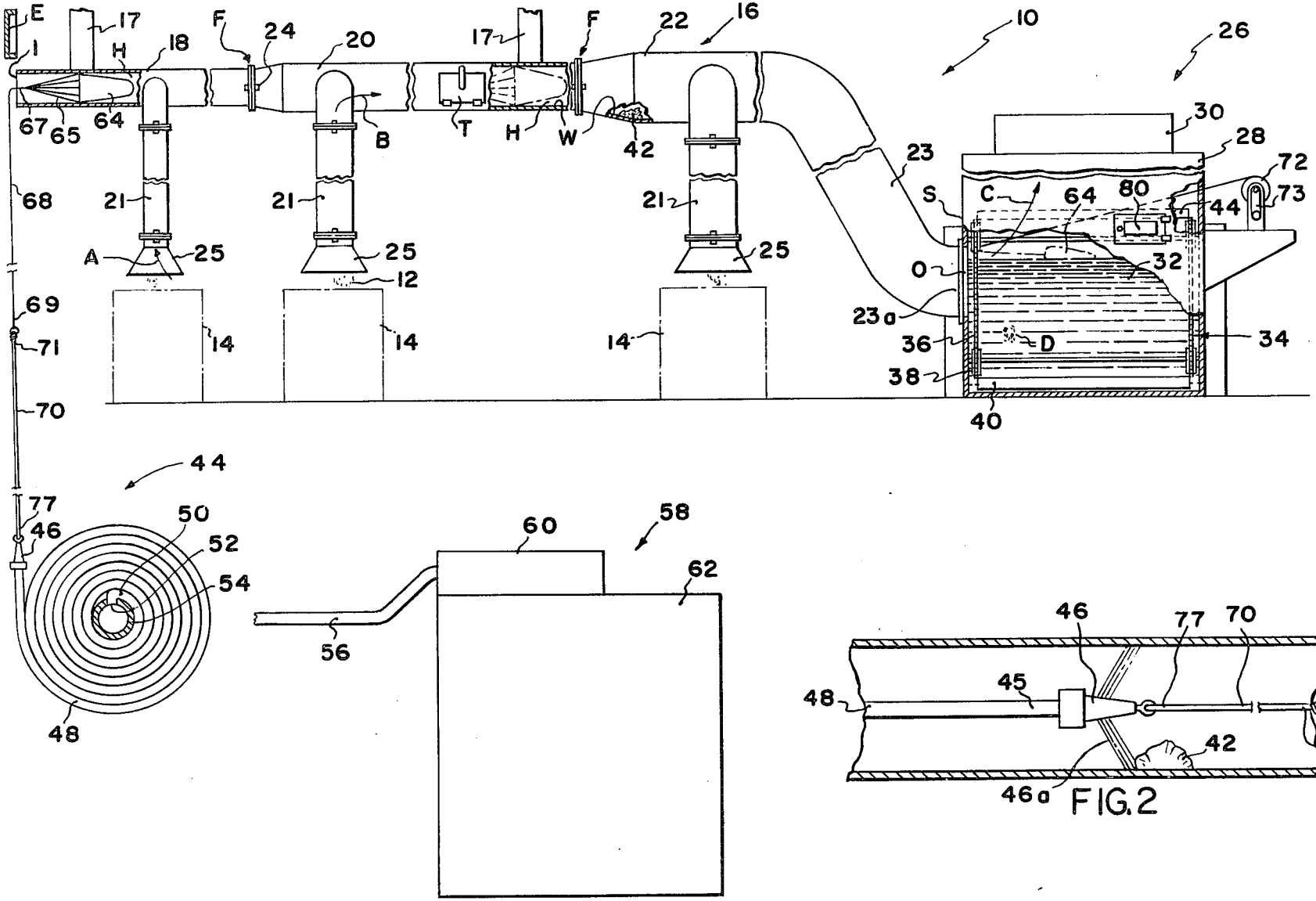
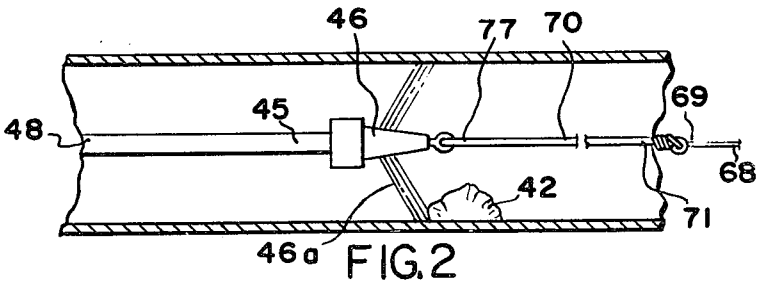
FIG.2

METHOD AND APPARATUS FOR CLEANING SUCTION DUCTS

BACKGROUND OF THE INVENTION

This invention relates to method and apparatus for in situ cleaning of suction ducts which are utilized in an air exhaust system for removing particles of machining entrained in the air at a machining station. More particularly, this invention relates to method and apparatus for cleaning such suction ducts via a newly improved system for initially feeding the system through the duct. During the machining of a part, machines, such as milling or grinding machines, cast off fine waste particles. At least some of such particles remain entrained in the air adjacent the machines, and contaminate the breathing air. Such machines typically utilize cooling oil to maintain the cutting tool at a predetermined temperature and a portion of the oil will form into mist which will also be entrained in the air in and about the grinding and milling machines. In machine shops, environmental control, air and dirt exhaust systems have been provided for exhausting air adjacent milling machines and grinding machines so that the waste particles of machining and the oil mist which is entrained in the air, are drawn away from the machine and the machine operator. As the dirt and oil laden air are drawn through the exhaust ducts, some of the dirt and oil will gravitate to and adhere to the inside wall of the exhaust ducts. Continued buildup of the oil and dirt in the ducts will tend to close the ducts and the vacuum forces upstream of the oil and dirt accumulation will be reduced to a level insufficient to maintain an efficient exhaust system. It has been conventional to periodically dismantle the ducts into duct sections, deposit the duct sections in a liquid filled vat and then "boil" the insides of the ducts or conduit sections. This method is of course time consuming, expensive and renders the entire machining operation inoperative during the cleaning process. Accordingly, it is an object of the present invention to provide a new and novel method and apparatus for the in situ cleaning of an air and dirt evacuation exhaust system.

The duct work conventionally utilized in an air evacuation system extends overhead for a substantial distance throughout a machining plant. It has been found that the dirt, sludge, and scale which accumulate on the inside of the pipes can be removed from the duct wall via a fluid emitting nozzle, which emits fluid against the accumulated sludge. Due to the extreme length of the exhaust ducts, the initial feeding of a fluid emitting nozzle or the like through the duct has posed a substantial problem. Accordingly, it is another object of the present invention to provide method and apparatus for cleaning suction ducts which includes new and novel apparatus for initially feeding the fluid emitting member through the duct.

The duct conventionally used in suction systems of the type described have a series of end-to-end, coupled duct sections which successively increase in diameter from the inlet end to the outlet end. The suction system of the type described sets up substantial air drawing forces which will be sufficient to draw items disposed in the duct through the duct. The apparatus constructed according to the present invention contemplates a "parachute" or "umbrella" type draft member which is disposed in the pipe or exhaust duct to be drawn by the vacuum forces in a downstream path of travel. The member being sucked downstream is attached to a draft line so that the draft line is drawn therewith to the outlet end whereby the downstream end of the line can be attached to a wench or the like at the downstream end of the duct. The upstream end of the line is coupled to a fluid emitting nozzle, adjacent the inlet duct end, so that the line, as it is moved downstream by the wench draws the nozzle through the duct. Accordingly, it is a further object of the present invention to provide method and apparatus for cleaning suction ducts of the type described which incorporates a draft member that is initially drawn downstream by the suction forces created by the dirt and air evacuating system.

It is another object of the present invention to provide a method and apparatus of the type described including mechanism for initially drawing a draft line member through a suction duct from the inlet end thereof to an outlet end thereof.

The duct sections successively decrease in diameter in a direction from the outlet duct end to the outlet duct end so that the suction forces at the upstream end are sufficient to draw waste particles of machining away from the machines located at the upstream end. Accordingly, it is yet another object of the present invention to provide method and apparatus of the type described including a draft member which, as it is drawn downstream, which will be expansible and contractible so as to remain in intimate engagement with the inside of the varying diameter duct sections.

It is yet another object of the present invention to provide method and apparatus for cleaning suction ducts and incorporating a parachute type draft member for drawing the draft line through the duct.

Yet another object of the present invention is to provide method and apparatus of the type described including a draft line having a downstream draft section which is relatively lightweight for movement with a parachute type draft member and an upstream, relatively heavier, draft line member for coupling the lightweight line to a fluid emitting nozzle.

Other objects and advantages of the present invention will become apparent to those of ordinary skill in the art as the description thereof proceeds.

SUMMARY OF THE INVENTION

In situ cleaning apparatus and method for removing dirt and scale which accumulates on the inside of a hollow, variable diameter, air and dirt duct evacuation system comprising a fluid emitting member disposable within the duct, a draft line disposable in the duct, having an upstream end coupled to the fluid emitting member, and mechanism coupled to the downstream end of the draft line for drawing the line through the duct comprising an expansible and contractible member disposable within the duct and movable by the suction forces to be drawn from the upstream duct end to the downstream duct end.

The present invention may more readily be understood by reference to the accompanying drawings in which:

FIG. 1 is a partly schematic, partly sectional, side elevational view of apparatus constructed according to the present invention; and FIG. 2 is a greatly enlarged, side elevational view of the draft line for drawing the parachute type draft member through the suction duct.

DESCRIPTION OF THE APPARATUS

Apparatus constructed according to the present invention is particularly adapted for use with an air and dirt evacuation or suction system, generally designated 10, for exhausting the air, which is entrained with dirt, machine chips, particles and oil mist, generally designated 12, from the immediate area of a plurality of machines generally designated 14, such as milling machines and grinding machines.

The suction system 10 comprises an overhead main duct, generally designated 16, which has a substantial length and passes throughout a machining plant. The duct 16 includes a series of duct sections 18, 20, 22 and 23, each including a hollow tube portion H and mounting flanges F at opposite ends thereof. The duct sections 18, 20, 22 and 23 are coupled end to end via the complemental, abutting flanges F and suitable bolts or clamps 24. The duct 16 is suspended from the plant ceiling on overhead beams (not shown) via hangers, generally designated 17. The downstream duct section 23 is illustrated as being vertically downwardly inclined. The downstream end **23*a* is coupled to a suction or vacuum creating system, generally designated 26, comprising a hollow, generally rectangular boxlike housing or frame, generally designated 28, mounting a suction creating exhaust fan, schematically designated 30. An opening O is provided in the sidewall S of the frame or housing 28 and is in alignment with the opening in the discharge end of 23*a* of duct section 23. A removable end cap E is mounted on the inlet end of the upstream duct section 18**.

The undersides of the duct sections 18, 20 and 22 mount vertical feeder duct sections 21 which, at their lower ends mount hoods 25 that overlie the machining stations 14. The vertical feeder duct sections 21 are, at their upper ends, in open fluid communication with the various horizontal duct sections 18, 20 and 22 for drawing the air and oil mist particles 12 upwardly in the direction of the arrow A and thence downstream in the horizontal duct 16 in the direction of the arrow B.

The frame 28 comprises a refuse tank containing bath or dirt cleaning water, generally designated 32. The level of the water bath 32 relative to the downstream end **23*a* of the downstream duct 23 is such that the evacuated air passes through a portion of bath as it moves through the sidewall opening O upwardly toward the exhaust fan 30. The evacuated dirt and air particles 12 will be moved downstream through the successive duct sections 18, 20, 22, 23 and as the air passes through the water 32, and moves upwardly in the direction of the arrow C to be exhausted as clean air, the air will be "washed" and the dirt generally designated D, remains in the bath 32. The dirt D, removed from the air will eventually gravitate to the bottom of the tank 28. A clean-out conveyor, generally designated 34, is provided in the tank 28 and includes laterally spaced, endless chains 36 trained around sprockets 38 and mounting paddles 40 for moving the dirt D upwardly and outwardly along a vertically inclined bottom tank wall. The dirt D is moved through the water 32 to a level above the level of water 32**. The dirt and sludge D will then be dumped in a gondola or carriage cart (not shown) which, when filled, will be moved to a remote location by a forklift truck or the like for disposal.

The air evacuation system described heretofore is entirely conventional. As the system is used, some of the oil mist and dirt being evacuated will gravitate to the inside walls of the duct sections and collect on the inside of the pipe, as illustrated at 42. The accumulation 42 will decrease the effective diameter of the duct system 16 and the efficiency of air and dirt removal will be decreased. Periodically, the insides of the ducts 16 must be cleaned. Heretofore, it has been conventional to disassemble the vertical feeder pipes 21, disconnect the variable diameter duct sections 18, 20, 22 and 23 and place the feeder pipes 21 and duct sections 18, 20, 22 and 23 in a fluid filled vat (not shown) where they are "boiled out" and cleaned. After the duct 16 and feeder pipes 21 are cleaned, they are then replaced in the position illustrated in FIG. 1.

Apparatus constructed according to the present invention, generally designated 44, is provided for the in situ cleaning of the duct 16 and the vertical feeder pipes 21. The cleaning apparatus comprises a fluid emitting nozzle 46 coupled to the downstream end 45 of a hose 48, having an upstream end 50 communicating with an opening 52 in the sidewall of a rotary, hollow hose mounting axle 54. The axle 54 is coupled, via a rotary coupling member (not shown), into fluid communication with a stationary cleaning fluid feeder hose 56 mounted to a water and solvent supply system, generally designated 58. The water and solvent supply system 58, includes a tank 62 mounting a high pressure pump 60 which will supply water and cleaning solvent in the tank 62 at a pressure of approximately 200–300 pounds per inch, to the feeder hose 56. The nozzle 46 which may be commercially purchased, emits the water and cleaning solvent radially outwardly toward the inside wall W of the duct 16 as illustrated at **46*a*. The solvent in the tank 62** may suitably comprise a mixture of 20 parts water and one part Sclean solvent manufactured by Foster Chemical Corporation Detroit, Michigan. SCLEAN solvent is a liquid non-corrosive, concentrated descaler having the following chemical composition:

Yellow Dye — 0.3 grams/drum
Sodium Hydroxide — 0.4%
Dowanol DPM — 3.82%
Trisodium Phosphate — 3.31%
Sodium Metasilicate — 5.22%
Triton X-100 — 3.82%
Triethanolamine — 1.12%
Versene #100 — 0.18% active SCLEAN solvent has a density of 8.91 lbs/gallon and is an amber colored liquid.

Apparatus is provided for initially feeding the fluid emitting nozzle 46 from the upstream duct section 18 to the downstream duct section 23 and comprises an expansible and contractible, parachute type draft member or umbrella shaped member generally designated 64. The parachute or umbrella 64 comprises a light fabric, sheet, such as nylon, and a plurality of perimetrically spaced lines 65 coupled to the perimetrical edges of the nylon sheet material 64. The parachute lines 65 are coupled to the downstream end 67 of the lightweight draft line 68.

The upstream endmost duct section 18 is closed by an end cap E which can be removed so that the umbrella or parachute member 64 can be inserted in an unfolded or collapsed condition into the duct section 18. Each of the duct sections 18, 20, 22 and 23 also includes a trap door T which can be opened to receive the parachute 64 at any selected section along the length of the duct 16, depending on the duct section which is clogged with scale 42. When the parachute type member 64 is disposed in the duct 18 for example, the suction forces created by the vacuum creating fan 30 will unfold the umbrella fabric so that the perimeter thereof is in wiping engagement with the duct wall W. The parachute or umbrella 64 will move downstream. The lightweight draft line 68 is sufficiently lightweight such that the parachute 64 will carry the lightweight line 68 therewith as the unfolded parachute 64 is moved from the upstream duct section 18 to the bath 32. The length of the lightweight wire 68 is greater than the length of the entire ductwork 16 and is sufficiently lightweight such that, even though the duct 16 has a substantial length, the suction forces created by the fan 30 will be sufficient to draw the wire from the inlet to the outlet.

The upstream end 69 of the wire 68 is coupled to a relatively heavier cable 70, such as a 3/16 inch diameter steel cable, which also has a length greater than the length of the ductwork 16. When the parachute 64 is drawn into the bath 32, the suction forces are insufficient to draw the parachute or umbrella 64 through the water. A trap door 80, swingably mounted on the frame 28, provides access to the inside of the frame 28 to enable the user to remove the parachute or umbrella 64 from the bath 32 of cleaning fluid. The parachute 64 is then "fished out" of the water 32 and the downstream end 67 of the wire 68 is uncoupled from the parachute lines 65 and coupled to a hand or motor driven wench 72 mounted on the frame 28. A handle 73 is provided for manually turning the wench 72 to wind the lightweight cable 68 therearound and draw the lightweight cable 68 through the duct 16. This will in turn draw the heavier cable 70 through the entire ductwork. When the downstream end 71 of the heavier cable 70 reaches the wench 72, the nozzle 46 coupled to the upstream end 77 of the heavier cable 70 is adjacent the inlet I of duct section 18. The cable 70 is relatively heavy and withstands the substantial forces exerted thereon necessary to pull the relatively heavy nozzle 46 through the duct 16.

As the parachute or umbrella 64 is moved from the upstream position, illustrated in solid lines in FIG. 1, to the downstream position illustrated in chain lines in FIG. 1, the parachute or umbrella 64 will successively inflate, unfold or expand radially outwardly so as to remain in intimate engagement with the inside wall of the successively increasing diameter duct sections 18, 20 and 22. This will insure that the maximum differential pressure is created on the opposite upstream and downstream sides of the sheet 64 to maintain maximum pulling force as the parachute 64 moves in a downstream path of travel.

The duct sections 18, 20, 22 and 23 are of a diameter not exceeding two to three feet and may be only 8 to 12 inches in diameter. The feeder pipes 21 are also of successively increasing diameters in a direction from an upstream machining station to a downstream machining station.

The air movement in the duct 16 is approximately 35 miles per hour. The trap doors T are provided on the duct sections 18, 20, 22 and 23 and permit the user to view the inside of the exhaust system to quickly view the plugged portion 42 of the system. The trap doors T also permit the installation of the parachute 64 at any selected duct section.

THE OPERATION AND METHOD OF CLEANING

The suction blower 30 is driven to create a vacuum which sucks or draws the air, machine waste and oil 12 upwardly through the feeder pipes 21 and then downstream through the various sections of the main duct 16. The waste and oil will be removed from the air by the wash water as the air percolates through the bath 32. Some of the oil and waste products will not remain entrained in the air stream for a sufficient length of time to reach the bath 32 but will precipitate to the wall of the feeder pipes and the duct 16, as illustrated at 42. To remove the dirt collection 42 in the duct section 18 as well as the remainder of the duct 16, the end plate E is removed from the upstream duct section 18 and the parachute type draft member or umbrella 64, after being connected to the lightweight line 68, is disposed in the upstream, terminal, or end duct section 18.

The parachute or umbrella 64, when subjected to the differential pressure created by the fan 30, expands or unfolds outwardly into bearing engagement with the inside wall W of the duct section 18. The differential pressure on opposite upstream and downstream sides of the parachute 64 will draw the parachute and the lightweight wire 68 downstream. As the parachute 64 passes downstream to the enlarged diameter duct section 20, the parachute 64 will continue to expand outwardly and remain in wiping engagement with the inside wall of the entire duct 16 so that the maximum differential pressure is maintained across the parachute 64. The parachute 64 will be drawn downstream into the bath 32.

The user then opens the trap door 80 and withdraws the parachute 64 from the bath and couples the downstream end 67 of the lightweight wire 68 to the wench 72. The upstream end 69 (FIG. 2) of the wire 68 is then coupled to the relatively heavier cable. The wench 72 is then operated to pull the lightweight wire 68 which in turn draws the heavier cable 70 through the duct 16 until the upstream, light weight line end 69 is adjacent the wench 72. The upstream end 77 of the heavier cable 70 is then coupled to the fluid emitting nozzle 46.

The fluid pump 60 is operated to force liquid cleaning fluid or solvent through the nozzle 46 as illustrated at 46*a*. The wench 72 is again operated to draw the cable 70 and the nozzle 46 downstream from the inlet duct section 16 to the discharge duct section 23. The cleaning solvent sprayed radially outwardly by the nozzle 46 will partially dissolve and "breakdown" the buildup of dirt deposits 42. Approximately one hour after the nozzle 46 is passed downstream to the duct section 23, the hose 48 is pulled in the reverse upstream direction and the wench 72 is permitted "free wheel" so that the nozzle 46 can be drawn in the opposite direction to the opposite end of the pipe 16 while fluid continues to be emitted by the nozzle 46.

The operation is repeated by passing the nozzle 46 to-and-fro until the scale 42 is broken away from the inside of the pipe. The smaller and lightweight portion of the particles 42 will be drawn downstream by the vacuum into the bath 32. Scale and particles 42 which are too large to be removed by the vacuum downstream to the bath, can be moved downstream to the bath 32 by a high pressure fluid emitted by the nozzle 46 as the nozzle is finally drawn through the pipe. The heavier cable 70 is then withdrawn from the duct 16 and the end cap E replaced.

The feeder pipes 21 can be cleaned in the similar manner by inserting the parachute or umbrella 64 in the lower end of the upstanding duct 21 to be cleaned. The parachute 64 is drawn by the vacuum upwardly into the main duct 16 and then downstream as previously recited. It is also possible to simultaneously clean all of the feeder pipes while the main duct is being cleaned by disposing a parachute 64 in each feeder pipe 21 before the heavier cable 70 is removed from the main duct 16. The parachute or umbrella 64 will be drawn upwardly into the main duct 16. The user will open the various trap doors T and decouple the parachutes, which have just passed through the upstanding feeder pipes 21, from the various lightweight line members 68 disposed in the feeder pipes 21. The user then pulls the lightweight wires 68 upwardly and outwardly through the open trap doors until the upstream ends 69 of the lightweight wires 68 are adjacent the trap doors T. The user then uncouples the lightweight wires 68 from the heavier cable 70 in each feeder pipe 21 and couples the vertical, heavier cables 70 to the main cable 70 lying in the duct 16.

If desired, the parachute 64 can be inserted in any selected one of the duct sections 18, 20, 22 and 23 without removing the end cap 66 by merely opening the appropriate trap door T.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. Apparatus for in situ cleaning of an exhaust system including a duct having an inlet and outlet and an internal diameter which increases in a downstream direction and a vacuum creating system at the downstream end of said duct for drawing air and dirt particles entrained in the air downstream for discharge, said cleaning apparatus comprising:

liquid emitting means movable downstream within said duct for emitting cleaning liquid toward the internal duct surfaces to dislodge any dirt which might accumulate on the internal surfaces of said duct as said liquid emitting means moves downstream;

means, downstream of said liquid emitting means, for forwardly drawing said liquid emitting means through said duct comprising:

a line coupled to said liquid emitting means, and variable diameter expansible and contractible draught means removably coupled to said line for initially drawing at least a portion of said line from said inlet to said outlet;

said expansible and contractible draught means being responsive to the vacuum forces created by said vacuum system to expand outwardly into intimate engagement with said internal surfaces and move in a downstream direction.

2. Apparatus as set forth in claim 1 wherein said liquid emitting means comprises a hose for supplying cleaning liquid and a liquid emitting nozzle mounted on the terminal end of said hose.

3. Apparatus as set forth in claim 1 wherein means is provided at the downstream end of said duct, connectable to the downstream end of said line after said draught means draws said line portion to said outlet, for moving the remaining upstream portion of said line through said duct.

4. The apparatus as set forth in claim 1 wherein said line includes a downstream line portion of a predetermined diameter, removably coupled to said draught means, and an upstream cable portion having a larger diameter removably coupled to said downstream portion and coupled to said liquid emitting means.

5. The apparatus as set forth in claim 1 wherein said draught means comprises a foldable and unfoldable umbrella which has a forwardly, converging, flexible sidewall.

6. In situ cleaning apparatus for removing dirt and scale on the internal surface of a hollow, variable diameter, air and dirt evacuation ductwork and the like, having an inlet and an outlet, and a vacuum creating system coupled to the downstream end of said ductwork, said cleaning apparatus comprising:

liquid emitting means disposable within said ductwork for emitting cleaning liquid toward the internal surfaces of said ductwork to discharge said dirt and scale;

means, downstream of said liquid emitting means, for drawing said liquid emitting means forwardly through said ductwork comprising:

draught means at at least the downstream end of said ductwork and coupling means, removably coupleable to said draught means and coupled to said liquid emitting means, for moving said liquid emitting means forwardly through said ductwork; and means for initially drawing said coupling means through said ductwork from said inlet to said outlet when said coupling means is decoupled from said draught means, so that said coupling means can be coupled to said draught means when the downstream end of said coupling means is at said outlet comprising:

expansible and contractible means disposable within said ductwork and responsive to a differential pressure being created on the opposite upstream and downstream sides thereof by said vacuum creating system to expand outwardly into intimate engagement with the internal surface of the variable diameter ductwork and to move in a downstream direction.

7. The apparatus as set forth in claim 6 wherein said coupling means includes a line initially coupled to said draught means and said coupling means for initially drawing said coupling means from said inlet to said outlet for coupling to said draught means after said draught means moves the downstream end of said coupling means to said outlet.

8. A method of in situ cleaning the inside of a suction duct having an upstream inlet and downstream outlet coupled to a vacuum creating system at the downstream end thereof comprising the steps of:

coupling an expansible and contractible member, which is responsive to a differential pressure being created on the opposite upstream and downstream sides thereof to expand to an expanded condition, to the downstream end of a draught line;

placing said expansible and contractible member, in a contracted condition, in said duct at said inlet and applying suction forces to the downstream side of said expansible and contractible member to cause said member to expand to said expanded condition into intimate engagement with the inside of the suction duct and to move at least said downstream end of said draught line in a downstream path of travel to said outlet; and coupling a liquid emitting member to the upstream end of said line and then drawing the upstream end of said line and said liquid emitting means into the upstream end of said duct after the downstream side of said line reaches said outlet.

9. The method as set forth in claim 8 wherein said line comprises a first, downstream line member having a predetermined weight per unit length, and a second, upstream line member having a predetermined greater weight per unit length; said first mentioned coupling step comprising the steps of initially coupling said expansible and contractible member to the downstream end of said first line member, and coupling the upstream end of said first line member to the downstream end of said second line member, and said step of applying suction forces includes the steps of drawing said lightweight member downstream to move the downstream end of said second line member through said duct to a position adjacent said outlet; said second mentioned coupling step including the steps of coupling the upstream end of said second line member to said liquid emitting means and then drawing said second line member in a downstream path to draw said liquid emitting means from said inlet to said outlet.

10. The method as set forth in claim 9 including the steps of reciprocally moving said second line member and said liquid emitting means in a to-and-fro path of travel.

* * * * *